US006922536B2

(12) United States Patent
Arimitsu et al.

(10) Patent No.: US 6,922,536 B2
(45) Date of Patent: Jul. 26, 2005

(54) PROCESS CARTRIDGE AND ELECTROPHOTOGRAPHIC IMAGE FORMING APPARATUS

(75) Inventors: Takeshi Arimitsu, Odawara (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/329,504

(22) Filed: Dec. 27, 2002

(65) Prior Publication Data

US 2003/0142991 A1 Jul. 31, 2003

(30) Foreign Application Priority Data

Dec. 28, 2001 (JP) ..... 2001-399089

(51) Int. Cl.[7] ..... G03G 15/00; G03G 21/18
(52) U.S. Cl. ..... 399/90; 399/111
(58) Field of Search ..... 399/90, 111, 113, 399/116, 117, 159

(56) References Cited

U.S. PATENT DOCUMENTS 6,240,266 B1 * 5/2001 Watanabe et al. ..... 399/117
6,311,026 B1 * 10/2001 Higeta et al. ..... 399/111 X
6,480,687 B1 11/2002 Kawai et al. ..... 399/111

FOREIGN PATENT DOCUMENTS

JP 04-282681 * 10/1992
JP 06-019227 * 1/1994
JP 10-039681 * 2/1998
JP HEI 10-254328 A 9/1998
JP 2001-166667 A 6/2001

* cited by examiner

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus, includes an electrophotographic photosensitive drum; a processor actable on the drum; an electroconductive shaft member supporting and electrically connected with the drum; a cartridge frame for rotatably supporting the drum; a grounding contact member mounted on the frame and including a sliding contact for sliding contact with the shaft member and a fixed contact contacted to an urging member provided in the assembly; a cartridge positioning member for positioning an axis of the drum, wherein the positioning member is urged to a positioning portion of the assembly by the fixed contact being urged by the urging member when the cartridge is mounted to the assembly, wherein by the fixed contact being contacted and urged by the urging member the drum is electrically grounded, and the cartridge positioning member is positioned relative to the positioning portion.

12 Claims, 9 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge employed by a copying machine, a printer, etc., employing an electrophotographic method. It also relates to an electrophotographic image forming apparatus employing such a process cartridge.

Herein, an electrophotographic image forming apparatus means an apparatus which forms images on recording medium with the use of an electrophotographic method. It includes, for example, an electrophotographic copying machine, an electrophotographic printer, (for example, laser beam printer, LED printer, etc.) a facsimileing apparatus, a wordprocessor, etc.

A process cartridge means a cartridge in which a charging means, a developing means or a cleaning means, as processing means, and an electrophotographic photoconductive drum are integrally disposed, and which is removably mountable in the main assembly of an electrophotographic image forming apparatus. It also means a cartridge in which at least one processing means among a charging means, a developing means, and cleaning means, as processing means, and an electrophotographic photoconductive member, are integrally disposed, and which is removably mountable in the main assembly of an electrophotographic image forming apparatus, and a cartridge in which a least a developing means, as a processing means, and an electrophotographic photoconductive drum are integrally disposed, and which is removably mountable in the main assembly of an electrophotographic image forming apparatus.

In an electrophotographic image forming apparatus (which hereinafter will be referred to simply as image forming apparatus), the peripheral surface of the photoconductive drum uniformly charged by the charging means is selectively exposed at numerous points. As a result, a latent image is formed on the peripheral surface of the photoconductive drum. The latent image is visualized with the developer (toner) supplied by the developing means. Then, the visualized image, that is, the image formed of developer, is transferred onto recording medium. Then, the developer image on the recording medium is fixed to the recording medium with the application of heat and pressure to make the developer image permanent.

Meanwhile, the developer remaining on the image bearing member after the transfer of the developer image is removed by a cleaning means, for example, a cleaning blade, and is stored, as residual developer (removed toner), in the cleaning means container. Thus, the development process for the following stage of an electrophotographic image forming operation can be carried out without the presence of the residual developer on the peripheral surface of the image bearing member.

Conventionally, an electrophotographic image forming apparatus using an electrophotographic image forming process employs a process cartridge system, according to which an electrophotographic photoconductive member, and a single or plurality of processing means which act on the electrophotographic photographic member, are integrally disposed in a cartridge removably mountable in the main assembly of an electrophotographic image forming apparatus. A process cartridge system enables a user to maintain an electrophotographic image forming apparatus by him/her self, that is, without relying on service personnel, drastically improving operational efficiency. Thus, a process cartridge system has been widely used in the field of an electrophotographic image forming apparatus.

Here, referring to FIG. 9, the method for grounding the above described electrophotographic photoconductive drum (which hereinafter will be referred to as photoconductive drum) when the photoconductive drum is employed by an image forming apparatus will be described.

The photoconductive drum 501 comprises a cylindrical aluminum member 501*a*, the peripheral surface of which is covered with a layer of photoconductive substance, and a pair of flanges 502*a* and 502*b* formed of a resin and integrally inserted into the lengthwise ends of the aluminum cylindrical member 501*a*, one for one.

The photoconductive drum 501 also comprises an electrically conductive shaft 503, which is put through the center holes of the resin flanges 502*a* and 502*b*. The electrically conductive shaft 503 rotates with at least the cylindrical member 501*a* and resin flange 502*a*.

The photoconductive drum 501 also comprises a contact 506, which is solidly fixed to the resin flange 502*a*, being placed in contact with both the internal surface 501*a*1 of the cylindrical aluminum member 501*a* and the peripheral surface of the electrically conductive shaft 503.

The electrically conductive shaft 503 extends from both of the lengthwise ends of the photoconductive drum 501 in the thrust direction (axial direction) of the photoconductive drum 501.

The lengthwise end portions of the electrically conductive shaft 503, which extend from the lengthwise ends of the photoconductive drum 501 one for one, are supported by a pair of bearings 504*a* and 504*b*, one for one, by their peripheral surfaces.

The bearings 504*a* and 504*b* are fitted in the bearing supporting portions of the shell portion 505 of the cartridge. Therefore, the photoconductive drum 501 is accurately positioned relative to the shell portion 505 of the cartridge.

To one of the lengthwise ends of the electrically conductive shaft 503, a cartridge driving force transmitting member 507 is solidly fixed. The outward surface of the cartridge driving force transmitting member 507, in terms of the axial direction of the photoconductive drum 501, is in the form of a coupler, so that the cartridge driving force transmitting member 507 is enabled to engage with the driving force transmitting member 508 on the main assembly side of the image forming apparatus to transmit driving force.

The image forming apparatus main assembly is provided with a drum grounding contact 509, which is placed in contact with the lengthwise end 503*a* of the electrically conductive shaft 503, grounding the photoconductive drum 501 by way of the following path: cylindrical member 501*a*→contact 506→electrical conductive shaft 503→drum grounding contact 509.

The present invention is the result of the further development of the above described prior art.

SUMMARY OF THE INVENTION

The primary object of the present invention is to provide a combination of a process cartridge and an electrophotographic image forming apparatus, which ensures that the photoconductive drum of the process cartridge is grounded and remains grounded.

Another object of the present invention is to provide a combination of a process cartridge and an electrophotographic image forming apparatus, which grounds the process cartridge by making the pressure generating member for keeping the process cartridge accurately positioned relative to the main assembly of the image forming apparatus double as the process cartridge positioning member and process cartridge grounding member.

Another object of the present invention is to provide a combination of a process cartridge and an electrophotographic image forming apparatus, which is capable of grounding the electrophotographic photoconductive drum of the process cartridge with the provision of a simple structural arrangement, that is, without providing the image forming apparatus with components dedicated to the grounding of the electrophotographic photoconductive drum.

Another object of the present invention is to provide a process cartridge comprising: an electrophotographic photoconductive drum comprising an electrically conductive shaft; a grounding contact which is attached to the frame of the process cartridge, and has a sliding contact point by which the grounding contact is placed in contact with the electrically conductive shaft, and a non-sliding contact point by which the grounding contact is directly pressed by a pressure applying member which is attached to the main assembly of the electrophotographic image forming apparatus and doubles as the grounding member on the main assembly side; and a cartridge positioning member which is kept pressed by the pressure applying member, on the cartridge positioning member on the electrophotographic image forming apparatus main assembly side, keeping thereby accurately positioned the axial line of the electrophotographic photoconductive drum relative to the apparatus main assembly, wherein as the grounding contact is kept pressed by the pressure applying member placed in contact with the non-sliding contact point of the grounding contact, not only is the electrophotographic photoconductive drum kept accurately positioned relative to the main assembly, but also, it is kept reliably grounded, and also, to provide an electrophotographic image forming apparatus in which such a process cartridge is removably mountable.

These and other objects, features, and advantages of the present invention will become more apparent upon consideration of the following description of the preferred embodiments of the present invention, taken in conjunction with the accompanying drawings.

Figure 1:
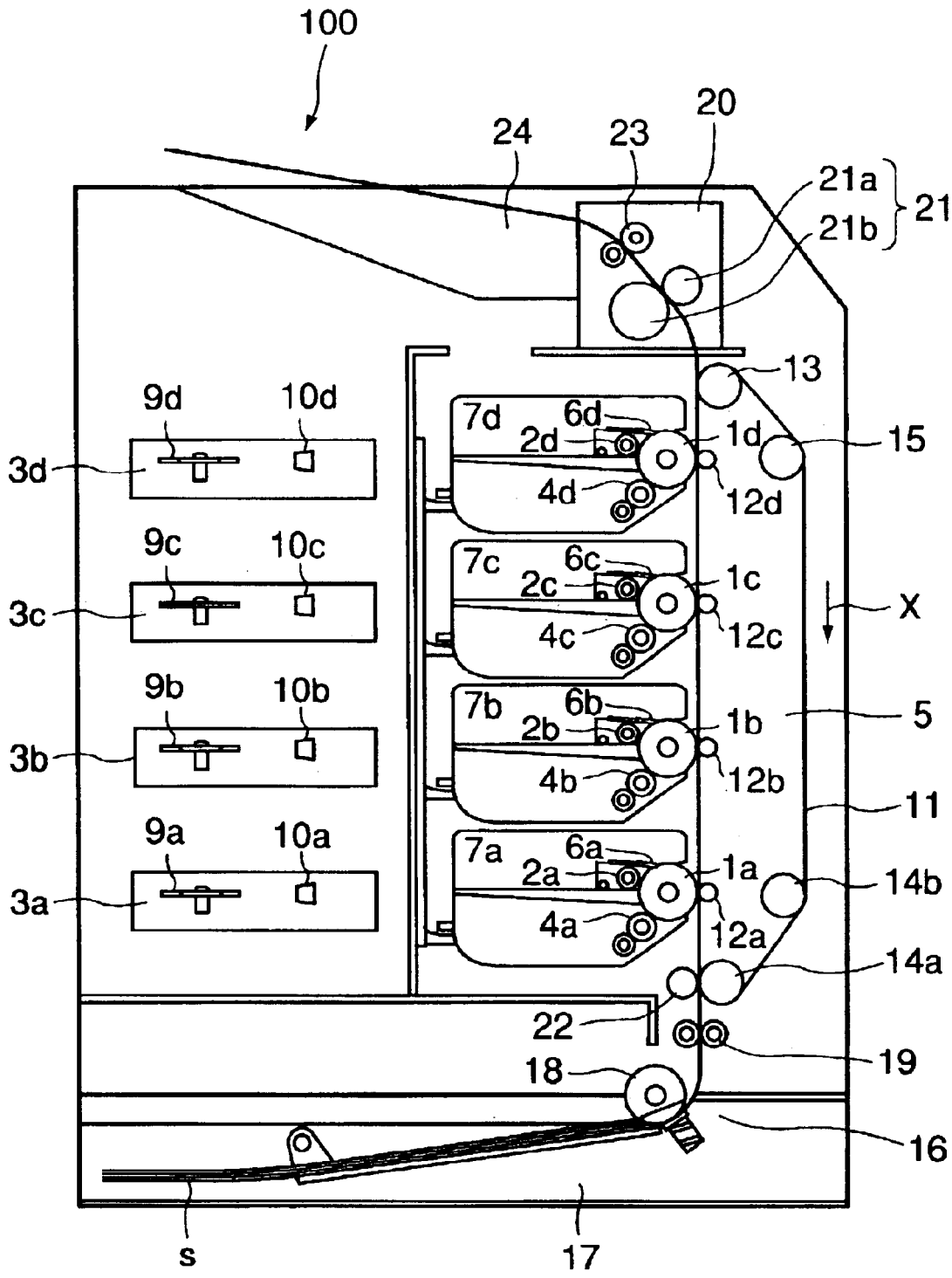
FIG. 1 is a vertical sectional view of the multicolor image forming apparatus in the first embodiment of the present invention.

DESCRIPTION OF THE PREFERRED EMBODIMENTS (Embodiment 1)

Hereinafter, the first embodiment of a multicolor image forming apparatus in accordance with the present invention will be described in more detail with reference to FIG. 1.

In the following descriptions, the lengthwise direction means the direction which is perpendicular to the direction in which recording medium is conveyed, and parallel to the surface of the recording medium. Regarding the alphanumeric references for the yellow, magenta, cyan, and black image forming portions, yellow, magenta, cyan, and black colors are represented by referential characters a, b, c, and k, respectively. Further, when any of the yellow, magenta, cyan, and black image forming portions, is referred to as an example of the image forming portions, or when all of them are referred to, the referential characters a, b, c, and d are not added to the numerical reference for the image forming portion; the image forming portion is referred to only by numerical references.

(General Structure of Multicolor Image Forming Apparatus)

First, the general structure of the multicolor image forming apparatus will be roughly described with reference to FIG. 1, which is a sectional view of a full-color laser beam printer as an example of an embodiment of a multicolor image forming apparatus in accordance with the present invention.

The main assembly 100 (which hereinafter may be referred to as apparatus main assembly) of the multicolor image forming apparatus in FIG. 1 comprises four electrophotographic photoconductive drums 1*a*, 1*b*, 1*c*, and 1*d* (which hereinafter will be referred to as photoconductive drums). The photoconductive drum 1 is rotationally driven by a driving means (unshown) in the counterclockwise direction of the drawing. In the adjacencies of the peripheral surface of the photoconductive drum 1, a charging apparatus 2 (2*a*, 2*b*, 2*c*, and 2*d*) as the primary charging means for uniformly charging the peripheral surface of the photoconductive drum 1, a scanner unit 3 (3*a*, 3*b*, 3*c*, and 3*d*) for forming an electrostatic latent image on the peripheral surface of the photoconductive drum 1 by scanning the peripheral surface of the photoconductive drum 1 with a beam of laser light modulated with image formation information, a developing apparatus 4 (4*a*, 4*b*, 4*c*, and 4*d*) for developing the electrostatic latent image into a toner image, by adhering toner to the electrostatic latent image, an electrostatic transferring apparatus 5 for transferring the toner image on the photoconductive drum 1 onto a transfer medium S, as a recording medium, and a cleaning medium apparatus 6 (6*a*, 6*b*, 6*d*, and 6*d*) for removing the toner particles remaining on the peripheral surface of the photoconductive drum 1 after the toner image transfer, etc., are disposed in the mentioned order, in terms of the rotational direction of the photoconductive drum 1.

Figure 2:
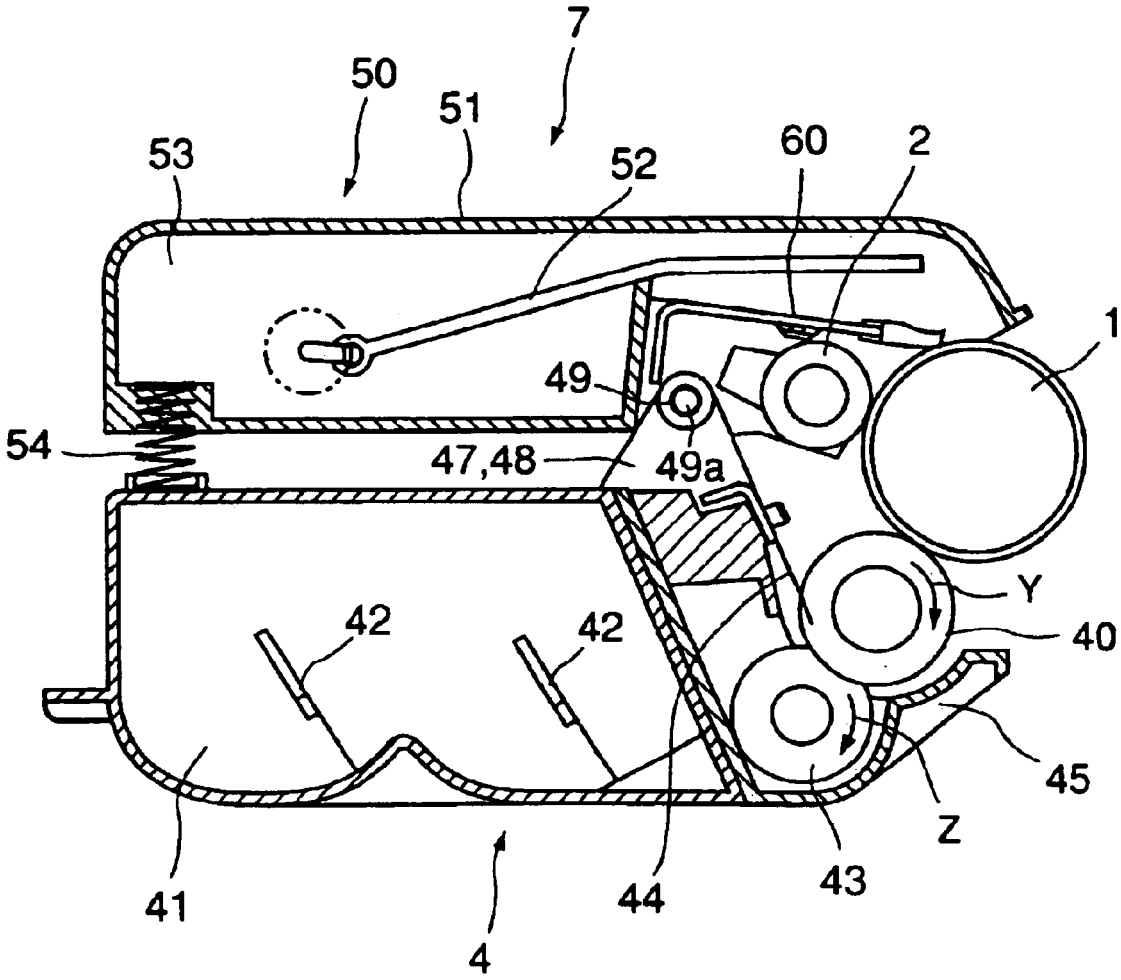
FIG. 2 is a vertical sectional view of the process cartridge in the first embodiment of the present invention.

The photoconductive drum 1, charging apparatus 2, developing apparatus 4, and cleaning apparatus 6 are integrally disposed in a cartridge, constituting the so-called process cartridge 7 (FIG. 2).

Next, the above mentioned components will be described in detail, starting from the photoconductive drum 1.

For example, the photoconductive drum 1 as an image bearing member comprises an aluminum cylinder with a diameter of 30 mm, and a layer of photoconductor coated on the peripheral surface of the aluminum cylinder. The photoconductive drum 1 is rotationally supported by supporting members, by its lengthwise ends. It is rotationally driven in the counterclockwise direction by the driving force transmitted to one of its lengthwise ends from a motor (unshown) provided on the apparatus main assembly 100 side.

As for the charging method used by the charging apparatus 2, one of the contact charging methods may be used. The charging member of the charging apparatus 2 is an electrically conductive member in the form of a roller. As charge bias is applied to the charge roller while the charge roller is kept in contact with the peripheral surface of the photoconductive drum 1, the peripheral surface of the photoconductive drum 1 is uniformly charged. In this embodiment, or the first embodiment, one of the reversal developing methods is used. Therefore, the peripheral surface of the photoconductive drum 1 is charged to the negative polarity.

Referring to FIG. 1, the scanner unit 3 is disposed virtually level with the photoconductive drum 1, and is structured so that a beam of image formation light, that is, the light emitted by the laser diode (unshown) of the scanner unit 3 while being modulated with image formation signals, is projected onto the polygon mirror 9 (9*a*, 9*b*, 9*d*, and 9*d*), spun at a high velocity by the scanner motor (unshown), and so that the image formation light deflected by the polygon mirror 9 is focused by the focusing lens 10 (10*a*, 10*b*, 10*c*, and 10*d*) on the charged peripheral surface of the photoconductive drum 1, selectively exposing numerous points on the peripheral surface of the photoconductive drum 1. Consequently, an electrostatic latent image is formed on the peripheral surface of the photoconductive drum 1.

Next, referring to FIG. 2, the developing apparatuses 4*a*, 4*b*, 4*c*, and 4*d* each have a toner container 41 containing yellow, magenta, cyan, and black toners, respectively. The toner in the toner container 41 is delivered by the toner delivery mechanism 42, to the toner supply roller 43 which is rotating in the clockwise direction indicated by an arrow mark (Z) in FIG. 2. The toner delivered to the toner supply roller 43 is coated onto the peripheral surface of the development roller 40, which is rotating in the clockwise direction indicated by an arrow mark (Y) in FIG. 2, by the toner supply roller 43 and the development blade 44 kept pressed upon the peripheral surface of the development roller 40. Thus, the toner is charged as it is coated onto the peripheral surface of the development roller 40.

As development bias is applied to the development roller 40 opposing the photoconductive drum 1 bearing a latent image, the toner on the peripheral surface of the development roller 40 is adhered to the peripheral surface of the photoconductive drum 1 in accordance with the pattern of the latent image; in other words, the latent image on the photoconductive drum 1 is developed into a toner image.

Referring again to FIG. 1, the electrostatic transferring apparatus 5 comprises an electrostatic conveying belt 11, which is circularly driven. The electrostatic conveying belt 11 is disposed in a manner to oppose all of the photoconductive drums 1*a*, 1*b*, 1*c*, and 1*d*, so that it remain in contact with all of the photoconductive drums 1*a*, 1*b*, 1*c*, and 1*d* as it is circularly driven in the direction indicated by an arrow X. As the material for the electrostatic conveying belt 11, a film formed of a resin, or a multilayer film comprising a substrate layer formed of a rubber and a layer of a resin coated on the substrate layer, may be employed. The electrostatic conveying belt 11 is stretched around the driving roller 13, follower roller 14*a*, and tension roller 15. As it is circularly moved, it keeps the transfer medium S electrostatically adhered to its outward surface, on the left-hand side, in terms of the loop it forms, in FIG. 1. As a result, the transfer medium S is conveyed by the electrostatic conveying belt 11 to the transfer point, where the toner image on the photoconductive drum 1 is transferred onto the transfer medium S.

The electrostatic transferring apparatus 5 also comprises four transfer rollers 12*a*, 12*b*, 12*c*, and 12*d*, which oppose the four photoconductive drums 1*a*, 1*b*, 1*c*, and 1*d*, respectively, being placed in parallel and in contact with the inward surface of the electrostatic conveying belt 11, in terms of the loop formed by the belt 11. To the transfer roller 12, bias voltage positive in polarity is applied to give the transfer medium S positive charge through the electrostatic transfer belt 11. As the bias voltage positive in polarity is applied to the transfer roller 12, the toner image on the photoconductive drum 1, which is negative in polarity, is transferred onto the transfer medium S by the electric field generated by the bias application.

A transfer medium feeding/conveying portion 16 is for feeding the transfer medium S into the apparatus main assembly and conveying it to the image forming portion. A cassette 17 stores a plurality of transfer mediums S. During image formation, the feeding roller 18 (semicylindrical roller) and a registration roller pair 19 are rotationally driven in synchronism with the image formation, in order to separate the transfer mediums S in the cassette 7 one by one, and to sequentially feed the transfer mediums S into the apparatus main assembly and convey them to the transfer points. More specifically, as the leading edge of each transfer medium S comes into contact with the registration roller pair 9, the transfer medium S is temporarily prevented from advancing. As a result, the transfer medium S slightly curves. Then, the transfer medium S is released by the registration roller pair 9 in synchronism with the image formation, onto the electrostatic transfer belt 11 so that the arrival of the transfer starting line on the transfer medium S at the transfer point (line) coincides with the arrival of the leading end (line) of the toner image on the photoconductive drum 1 at the transfer point (line).

The fixing portion 20 is for fixing to the transfer medium S a plurality of the unfixed toner images, different in color, which have been transferred onto the transfer medium S. It has a fixation roller pair 21 for applying heat and pressure to the transfer medium S. The fixing roller 21 comprises a rotational heat roller 21*a*, and a pressure roller 21*b* kept pressed upon the rotational roller 21*a* to apply heat and pressure to the transfer medium S.

To describe the operation of the fixing portion 20, as the transfer medium S, bearing the unfixed toner images which have been transferred from the photoconductive drum 1, is passed through the fixing portion 20 by the fixation roller pair 21, heat and pressure is applied to the transfer medium S by the fixation roller pair 21. As a result, the plurality of unfixed toner images different in color are fixed to the surface of the transfer medium S.

As for the image forming operation, the process cartridges 7*a*, 7*b*, 7*c*, and 7*d* are sequentially driven in synchronism with the printing timing, and the photoconductive drums 1*a*, 1*b*, 1*c*, and 1*d* are rotationally driven in the counterclockwise direction in synchronism with the timing with which the process cartridges 7*a*, 7*b*, 7*c*, and 7*d* are driven. Also, the scanner units 3*a*, 3*b*, 3*c*, and 3*d*, which oppose the process cartridges 7*a*, 7*b*, 7*c*, and 7*d*, respectively, in the process cartridges 7*a*, 7*b*, 7*c*, and 7*d*, are sequentially driven in synchronism with the rotations of the photoconductive drums 1*a*, 1*b*, 1*c*, and 1*d*, respectively. As the photoconductive drum 1 is rotationally driven, the peripheral surface of the photoconductive drum 1 is uniformly charged by the charge roller 2, and is exposed to the beam of light projected by the scanner unit 3 while being modulated with the image formation signals. As a result, an electrostatic latent image is formed on the peripheral surface of the photoconductive drum. The development roller 40 in the developing apparatus 4 transfers the toner therein onto the points of the electrostatic latent image, which are lower in potential level. As a result, a visible image is formed of toner, on the peripheral surface of the photoconductive drum 1; the electrostatic latent image is developed into a toner image.

The rotation of the registration roller pair 19 is started to release each transfer medium S onto the electrostatic transfer belt 11 so that, as the electrostatic transfer belt 11 is circularly driven, the leading edge of the toner image on the peripheral surface of the photoconductive drum 1*a*, that is, the most upstream photoconductive drum 1 in terms of the transfer medium conveyance direction, and the predetermined transfer starting line of the transfer medium S, arrive, at the same time, at a predetermined point (line) in the contact area between the photoconductive drum 1*a* and electrostatic transfer belt 11.

Arriving at the contact area between the electrostatic adhesion roller 22 and electrostatic transfer belt 11, the transfer medium S is nipped between the electrostatic adhesion roller 22 and electrostatic transfer belt 11, being thereby pressed upon the electrostatic transfer belt 11. Further, voltage is applied between the electrostatic transfer belt 11 and electrostatic adhesion roller 22, inducing thereby electrical charge in the transfer medium S, which is dielectric, and the dielectric layer of the electrostatic transfer belt 11. As a result, the transfer medium S is electrostatically adhered to the outward surface of the electrostatic transfer belt 11, and is conveyed by the electrostatic transfer belt 11 up to the most downstream transfer portion, remaining reliably adhered to the electrostatic transfer belt 11. The electrostatic adhesion roller 22 opposes the follower roller 14*a* with the interposition of the electrostatic transfer belt 11.

While the transfer medium S is conveyed in the manner described above, the toner image on the photoconductive drum 1*a*, toner image on the photoconductive drum 1*b*, toner image on the photoconductive drum 1*c*, and toner image on the photoconductive drum 1*d*, are sequentially transferred onto the transfer medium S by the electric fields generated between the photoconductive drums 1*a*, 1*b*, 1*c*, and 1*d*, and the transfer rollers 12*a*, 12*b*, 12*c*, and 12*d*, respectively.

After the transfer of the four toner images different in color onto the transfer medium S, the transfer medium S is separated from the electrostatic transfer belt 11 due to the curvature of the belt driving roller 13, and is conveyed into the fixing portion 20, in which the four toner images are thermally fixed to the transfer medium S. Then, the transfer medium S is discharged from the apparatus main assembly by the discharge roller pair 23, with its image bearing surface facing downward, through the print discharging portion 24.

Figure 3:
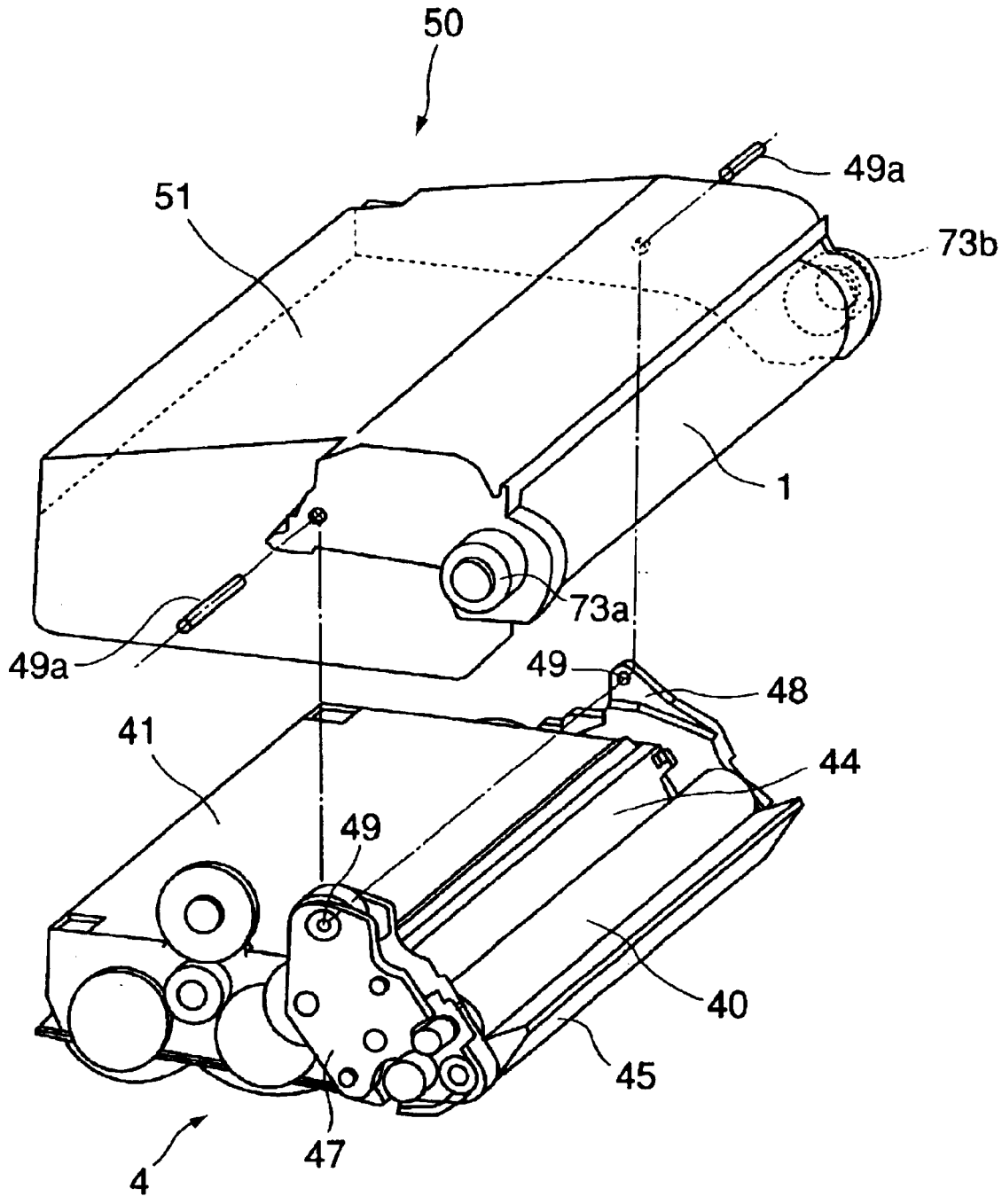
FIG. 3 is a perspective view of the process cartridge in the first embodiment of the present invention, for showing how the cleaner unit frame and developing apparatus of the process cartridge are connected to each other.

Next, referring to FIGS. 2 and 3, the process cartridge 7 in accordance with the present invention will be described in detail. FIG. 2 is a sectional view of the process cartridge 7 at a plane perpendicular to the lengthwise direction of the photoconductive drum 1, and FIG. 3 is a perspective view of the process cartridge 7. The process cartridges 7*a*, 7*b*, 7*c*, and 7*d* for yellow, magenta, cyan, and black color components, respectively, are the same in structure.

The process cartridge 7 comprises a cleaner unit 50 and a developing apparatus 4. The cleaner unit 50 comprises the photoconductive drum 1 as an image bearing member, primary charging means, and cleaning means, and the developing apparatus 4 has the developing means for developing the electrostatic latent image on the photoconductive drum 1. The components of the developing apparatus 4 are unitized. Hence, the developing apparatus 4 is sometimes referred to as development unit 4.

The cleaner unit 50 also comprises a cleaner unit frame 51 as a part of the cartridge frame, to which the photoconductive drum 1 is rotationally attached with the-interposition of the bearings 73*a* and 73*b*. Disposed in contact with the peripheral surface of the photoconductive drum 1 are the charging apparatus 2 as the primary charging means for uniformly charging the photoconductive layer, which is the outermost layer of the photoconductive drum 1, and the cleaning blade 60 for removing the developer (residual toner) remaining on the photoconductive drum 1 after the toner image transfer. After being removed from the peripheral surface of the photoconductive drum 1 by the cleaning blade 60, the residual toner (removed toner) is gradually sent by the toner sending mechanism 52 into the removed toner chamber 53 located in the rear portion of the cleaner unit frame 51.

The development unit 4 comprises the development roller 40, toner container 41, and development unit frame 45. The development roller 40 rotates in the direction indicated by the arrow mark Y, in contact with the photoconductive drum 1, and the toner container 41 stores the toner. The development roller 40 is rotationally supported by the development unit frame 45 with the interposition of bearings (unshown). The development unit 4 further comprises the toner supply roller 43 and development blade 44, which are disposed in contact with the peripheral surface of the development roller 40. The toner supply roller 43 rotates in the direction indicated by the arrow mark Z, in contact with the peripheral surface of the development roller 40. The toner container also contains a toner conveying mechanism 42 for conveying the toner in the toner container to the toner supply roller 43 while stirring the toner.

The development unit 4 is provided with a pair of arms attached to the lengthwise ends of the development unit 4, one for one, and the pair of arms are provided with bearings 47 and 48, one for one. The development unit 4 is connected to the cleaner unit 50, with a pair of development unit supporting pins 49*a* inserted in the holes 49 of the cleaner unit 50 and the bearing 47 and 48 of the development unit 4, being suspended from the cleaner unit 50 in such a manner that the entirety of the development unit 4 is enabled to pivot about the pair of pins 49*a*. The process cartridge 7 is provided with a pair of compression springs 54 disposed between the development unit 4 and cleaner unit 50 in such a manner that the development roller 40 is kept in contact with the photoconductive drum 1 by the resiliency of the compression springs 54.

During development, the toner in the toner container 41 is conveyed to the toner supply roller 43 by the toner stirring mechanism 42. As the toner is supplied to the toner supply roller 43, which is rotating in the arrow Z direction, the toner is supplied to the development roller 40; as the toner supply roller 43 rotating in the arrow Z direction rubs against the development roller 40 rotating in the arrow Y direction, the toner is borne onto the development roller 40 by being rubbed onto the development roller 40.

The toner borne on the development roller 40 is brought to the development blade by the rotation of the development roller 40. At the toner blade 44, the body of the toner on the development roller 40 is regulated in thickness, becoming a thin layer of toner, while being given a desired amount of electric charge. Then, as the development roller 40 rotates further, the thin layer of toner on the development roller 40 is conveyed to the development point, that is, the contact area between the photoconductive drum 1 and development roller 40, in which the toner particles in the thin layer of toner on the development roller 40 are adhered to the electrostatic latent image on the peripheral surface of the photoconductive drum 1 (electrostatic latent image is developed), by the development bias voltage, that is, DC voltage applied to the development roller 40 from an unshown electric power source. As the development roller 40 is further rotated, the residual toner particles, that is, the toner particles which remained on the peripheral surface of the development roller 40 without contributing to the development of the electrostatic latent image, are moved back into the developing device, in which the residual toner particles are stripped from the peripheral surface of the development roller 40 by the toner supply roller 43 as the toner supply roller 43 rubs against the peripheral surface of the development roller 40; in other words, the residual toner particles are recovered. The recovered residual toner particles are mixed into the toner in the developing device by the toner stirring mechanism 42 as the recovered residual toner particles and the toner in the developing device are stirred together by the toner stirring mechanism 42.

In the case of a contact developing method, which is a development method in which the photoconductive drum 1 is placed in contact with the 1*d* development roller 40 as in this embodiment, the photoconductive drum 1 is desired to be rigid, whereas the surface layer (portion which makes contact with photoconductive drum 1) of the development roller 40 is desired to be elastic. As the material for this elastic surface layer of the development roller 40, solid rubber or the like is used. In consideration of the fact that the surface layer of the development roller 40 is required to give the toner a satisfactory amount of electric charge, the surface of the layer formed of solid rubber or the like may be coated with resin.

Described next will be the method for accurately positioning the photoconductive drum 1 relative to the apparatus main assembly 100, and method for establishing electrical connection between the photoconductive drum 1 and apparatus main assembly 100, as the process cartridge 7 in the first embodiment of the present invention is mounted into the apparatus main assembly 100.

Figure 4:
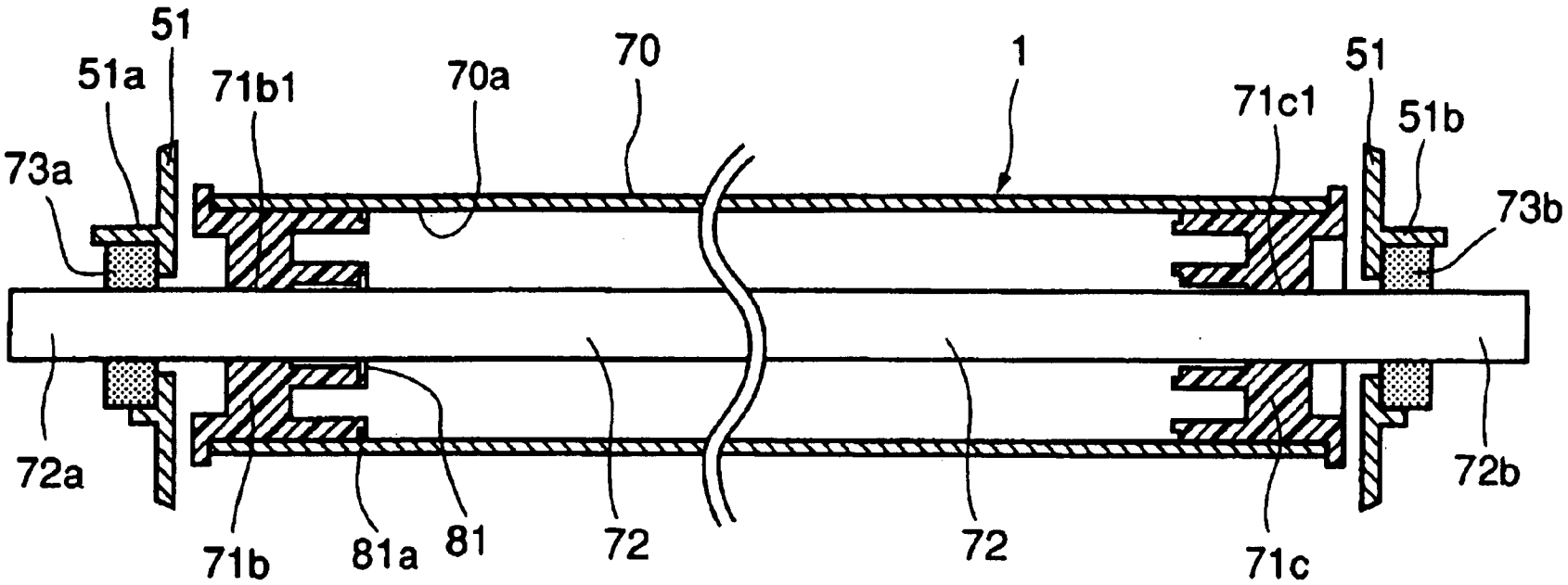
FIG. 4 is a sectional view of the photoconductive drum and photoconductive drum supporting portion of the process cartridge, in the first embodiment of the present invention.

Referring to FIG. 4, the structure of the process cartridge 7 will be described.

The photoconductive drum 1 comprises: a cylindrical member 70, the peripheral surface of which is coated with a layer of photoconductor; a pair of flanges 71*b* and 71*c*, which are formed of a resin, and are fitted in the lengthwise ends (axial direction) of the cylindrical member 70, one for one; and a contact 81 solidly fixed to the flange 71*b* or both the flanges 71*b* and 71*c*, and placed in contact with the internal surface 70*a* of the cylindrical member 70. These components of the photoconductive drum 1 are unitized as the photoconductive drum 1. The resin flanges 71*b* and 71*c* are provided with through holes 71*b*1 and 71*c*1, the axial lines of which coincide with the axial line of the cylindrical member 70, and in which the electrically conductive shaft 72 is fitted.

The electrically conductive shaft 72 is in contact with the contact 81 at a contact point 81*a*, establishing electrical connection between the cylindrical member 70 and electrically conductive shaft 72. The electrically conductive shaft 72 extends outward from both of the lengthwise ends of the photoconductive drum 1, constituting the extensions 72*a* and 72*b*, by which the photoconductive drum 1 is rotationally supported by the bearings 73*a* and 73*b* which rotationally support the electrically conductive shaft 72. The bearings 73*a* and 73*b* are solidly fixed to the bearing supporting portions 51*a* and 51*b* of the cleaner unit frame 51. Thus, the photoconductive drum 1 is accurately positioned relative to the cleaner unit frame 51 with the interposition of the-bearings 73*a* and 73*b*.

Figure 5:
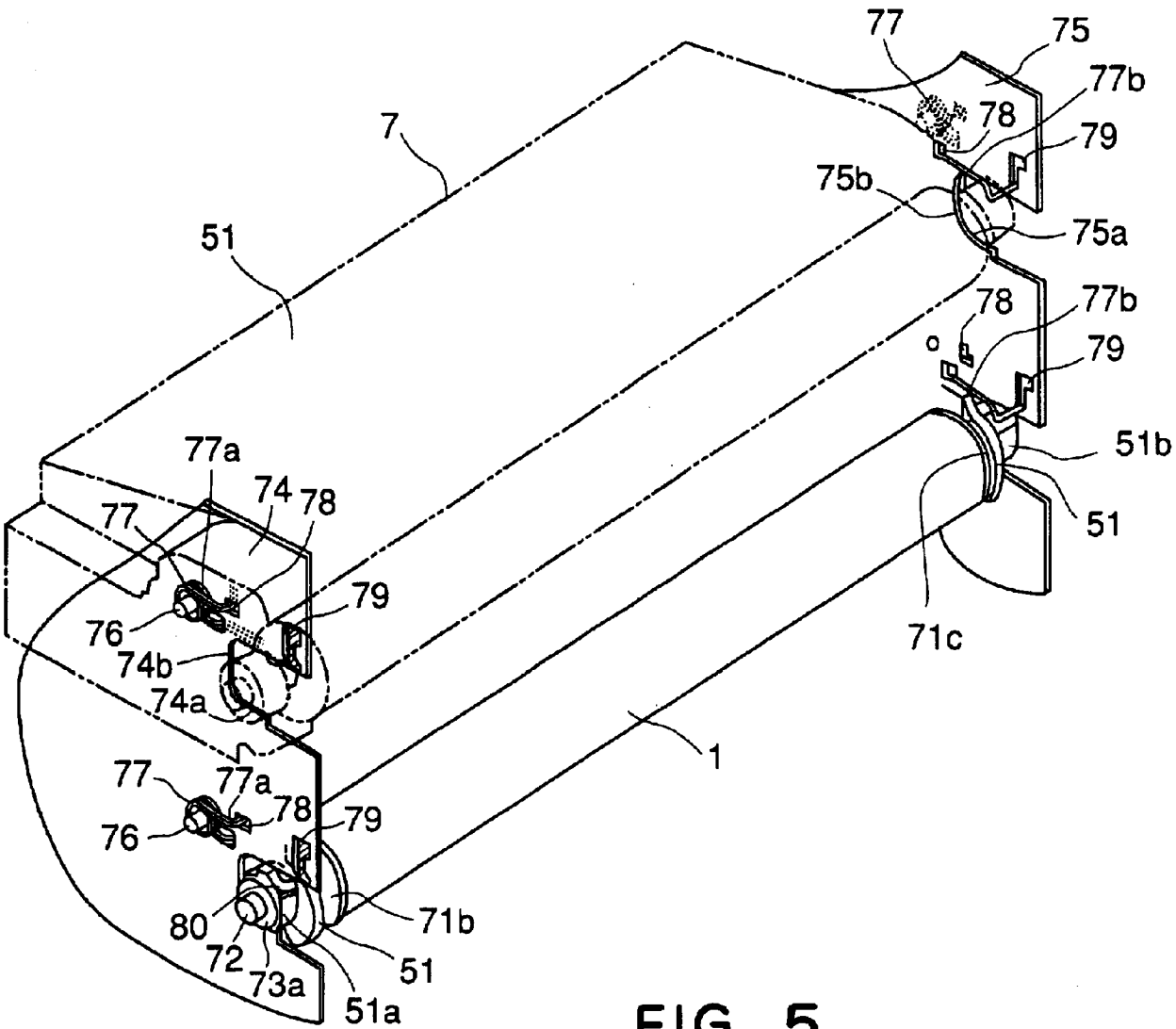
FIG. 5 is a perspective view of the process cartridge and the process cartridge supporting portion of a multicolor image forming apparatus.
Figure 6:
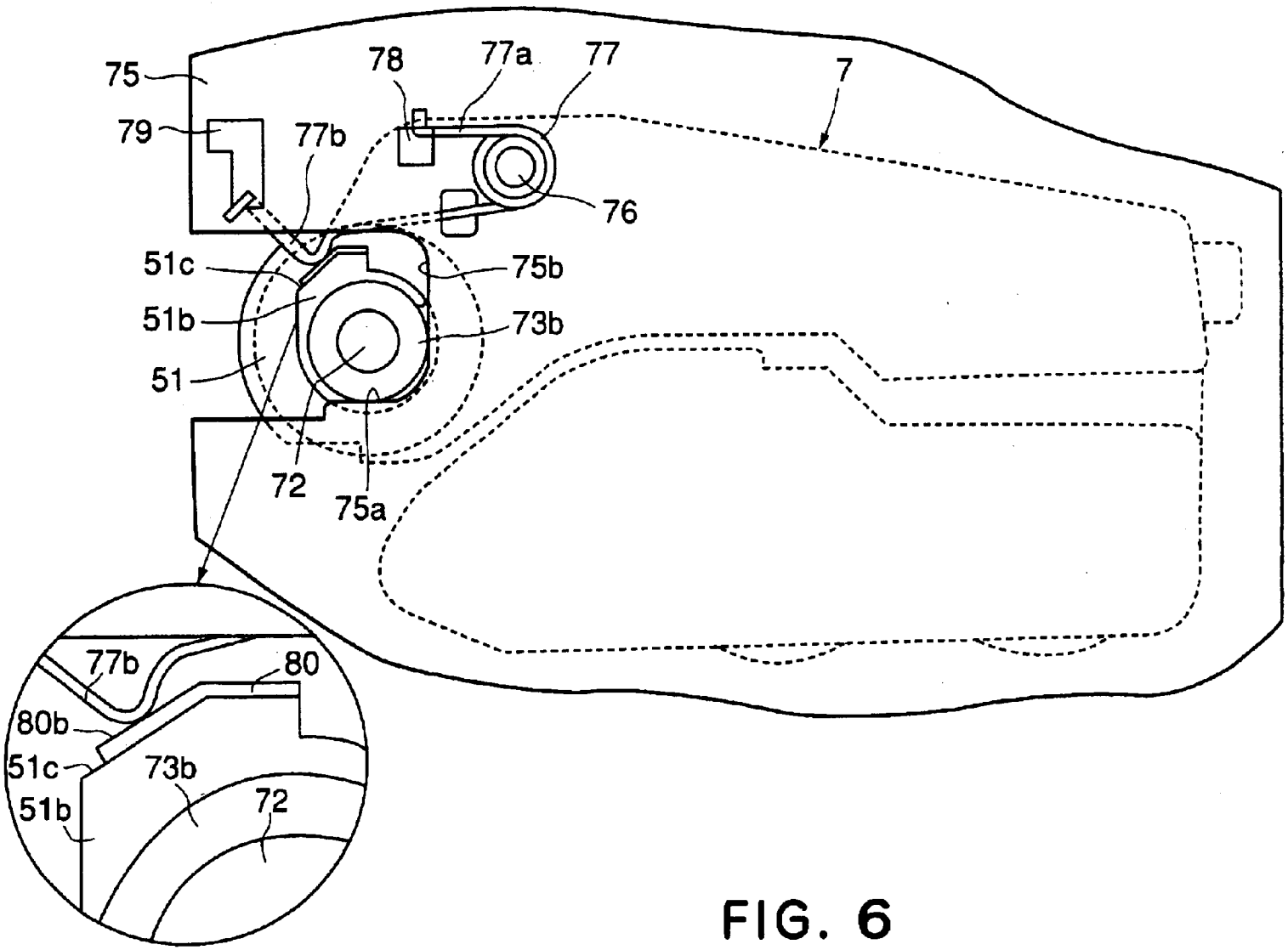
FIG. 6 is a side view of the process cartridge and the process cartridge supporting portion of the multicolor image forming apparatus in the first embodiment of the present invention, for showing the method for accurately positioning the process cartridge relative to the main assembly of the image forming apparatus.

Next, referring to FIGS. 5 and 6, the positioning of the process cartridge 7 and photoconductive drum 1 relative to the apparatus main assembly 100 will be described. The bearings 73*a* and 73*b* are attached to the left and right metallic side plates 74 and 75, respectively, (which correspond one for one to ends of axial line of photoconductive drum) of the apparatus main assembly 100, being positioned so that their peripheral surfaces are in contact with the left and right side plates 74 and 75. The left and right side plates 74 are provided with bearing positioning surfaces 74*a* and 74*b*, and right side plate 75 is provided with bearing positioning surfaces 75*a* and 75*b*. The peripheral surfaces of the bearings 73*a* and 73*b* are kept pressed against the bearing positioning surfaces 74*a* and 74*b*, and the bearing positioning surfaces 75*a* and 75*b*, respectively, whereby the photoconductive drum 1 is accurately positioned relative to the left and right side plates 74 and 75 with the interposition of the bearing 73*a* and 73*b*, respectively. Further, for the positioning of the photoconductive drum 1, the photoconductive drum 1 is kept pressed on the left and right side plates 74 and 75.

Next, referring to FIGS. 5 and 6, the method for keeping the photoconductive drum 1 pressed upon the left and right side plate 74 and 75 will be described. Herein, the method will be described in detail regarding only one (right side plate 75) of the lengthwise ends of the photoconductive drum 1. The method regarding the other end is the same as the method which will be described next. Referring to FIG. 6, except for the portions of the peripheral surface of the bearing 73*b*, by which the bearing 73*b* is in contact with the bearing positioning surfaces 75*a* and 75*b* of the right side plate 75, the peripheral surface of the bearing 73*b* is covered with the bearing supporting portion 51*b*, that is, a part of the cleaner unit frame 51, for supporting the bearing 73*b*.

In comparison, the right side plate 75 is provided with a metallic shaft 76, which is attached to the right side plate 75 by crimping. The shaft 76 supports a helical torsion spring 77, which is kept wound in a manner to make the arm portions 77*a* and 77*b* of the helical torsion spring 77 come closer to each other so that force is generated by the resiliency of the spring 77 in the direction to move the two arm portions 77*a* and 77*b* away from each other. One of the arm portions 77*a*, that is, one end of the piece of springy wire constituting the helical torsion spring 77, is solidly attached to the right side plate 75 by being fitted in the hole 78 of the right side plate 75, whereas the arm portion 77*b*, or the other end of the piece of springy wire constituting the helical torsion spring 77, is rested on the edge of the hole 79 of the right side plate 75, with the bent portion of the arm portion 77*b* hitched to the edge of the hole 79, being prevented from moving in the direction to unwind the helical torsion spring 77 when the process cartridge 7 is out of the apparatus main assembly 100. When the process cartridge 7 is in the apparatus main assembly 100, the arm portion 77*b*, or the other end of the helical torsion spring 77, is kept pressed upon the spring pressure bearing portion 51*c* of the cleaner unit frame 51, accurately positioning the process cartridge 7 and photoconductive drum 1 relative to the right side plate 75.

Figure 7:
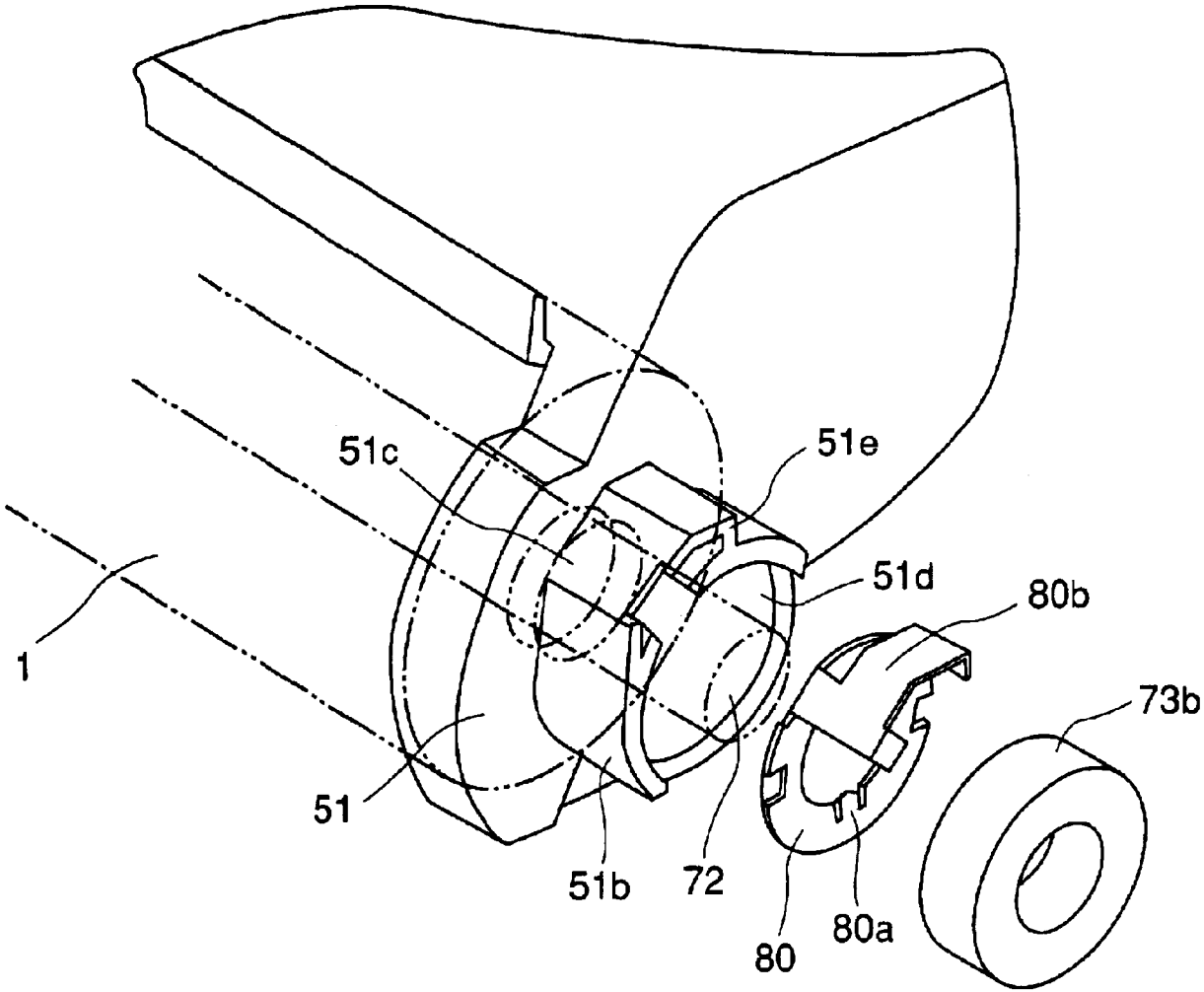
FIG. 7 is a perspective view of the grounding contact located at one of the lengthwise ends of the photoconductive drum in the process cartridge in the first embodiment of the present invention, for showing the the structure of the grounding contact.

Next, referring to FIGS. 5–7, the method for grounding the photoconductive drum 1 will be described. The bearings 73*a* and 73*b* are rolling bearings, for example, and double as the positioning members on the cartridge side for accurately positioning the axis of the photoconductive drum 1 relative to the apparatus main assembly 100. In comparison, on the apparatus main assembly side, the bearing positioning surfaces 74*a* and 74*b* of the left side plate 74, and the bearing positioning surfaces 75*a* and 75*b* of the right side plate 75, of the apparatus main assembly function as the members for accurately positioning the process cartridge 7 relative to the apparatus main assembly 100.

The bearing supporting portion 51*b* of the id cleaner unit frame 51, and its adjacencies, are structured as follows. Referring to FIG. 6, the housing portion 51*d* of the cleaner unit frame 51 for supporting the bearing 73*b* is provided with a positioning rib 51*e* for regulating the position of the bearing 73*b* in terms of the thrust direction of the photoconductive drum 1. The process cartridge 7 is also provided with a grounding member 80, which is attached to the housing portion 51*d*, being on the inward side of the process cartridge 7 with respect to the bearing 73*b* in terms of the thrust direction of the photoconductive drum 1. The grounding member 80 is configured so that its arm portion 80*a* makes contact with the electrically conductive shaft 72 which extends outward through the housing portion 51*d*, and also, so that the grounding member 80 and the electrically conductive shaft 72 are enabled to move relative to each other, with the arm portion 80*a* of the grounding member 80 sliding on the peripheral surface of the electrically conductive shaft 72.

A part of the grounding member 80 is placed on the pressure bearing surface 51*c* of the cleaner unit frame 51 in a manner to cover the pressure bearing surface 51*c*, constituting the surface 80*b* which directly bears the pressure from the helical torsion spring 77. The helical torsion spring 77 is disposed so that it directly presses on the pressure bearing surface 80*b*, that is, non-sliding contact point of the grounding member 80, so that the bearing 73*b*, which doubles as positioning member, is kept pressed on the bearing positioning portions 75*a* and 75*b*, which are the process cartridge positioning portions on the apparatus main assembly 100 side, with the interposition of the housing portion 51*d* of the process cartridge 7. With the provision of this structural arrangement, not only can the process cartridge 7 be accurately positioned relative to the apparatus main assembly 100, but also, the photoconductive drum 1 can be grounded through the following path: cylindrical member 70→contact 81→electrically conductive shaft 72→grounding member 80→helical torsion spring 77→right side plate 75.

In other words, the photoconductive drum 1 can be grounded without providing the image forming apparatus main assembly 100 with additional contacts; the photoconductive drum 1 is grounded through the pressure generating member and right side plate 75. Herein, the side plates 74 and 75 are formed of metallic substance. As for the number and location of the photoconductive drum grounding means, a single photoconductive drum grounding means may be attached to, for example, the bearing supporting portion 51*a*, or two photoconductive drum grounding means may be attached to the bearing supporting portions 51*a* and id 51*b*, one for one.

According to the first embodiment, the grounding member 80 is kept pressed by the electrically conductive helical torsion spring 77 electrically connected to the right side plate 75 formed of metallic substance, and also, the peripheral surface of the bearing 73*b*, which doubles as the photoconductive drum positioning member, is kept pressed on the bearing positioning portions 75*a* and 75*b*, which are the process cartridge positioning portions on the apparatus main assembly 100 side. Therefore, it is assured that not only does the process cartridge 7 remain grounded, but also, it remains accurately positioned relative to the apparatus main assembly 100.

Further, the metallic plate 75 comprises the bearing positioning portion 75*a* and 75*b*, and the electrically conductive shaft 72 is grounded to the metallic plate 75 through the bearing 73*b* kept pressed on the metallic plate 75. Thus, it is further assured that the photoconductive drum 1 remains grounded, provided that the bearing 73*b* is formed of a metallic or electrically conductive substance.

(Embodiment 2)

Figure 8:
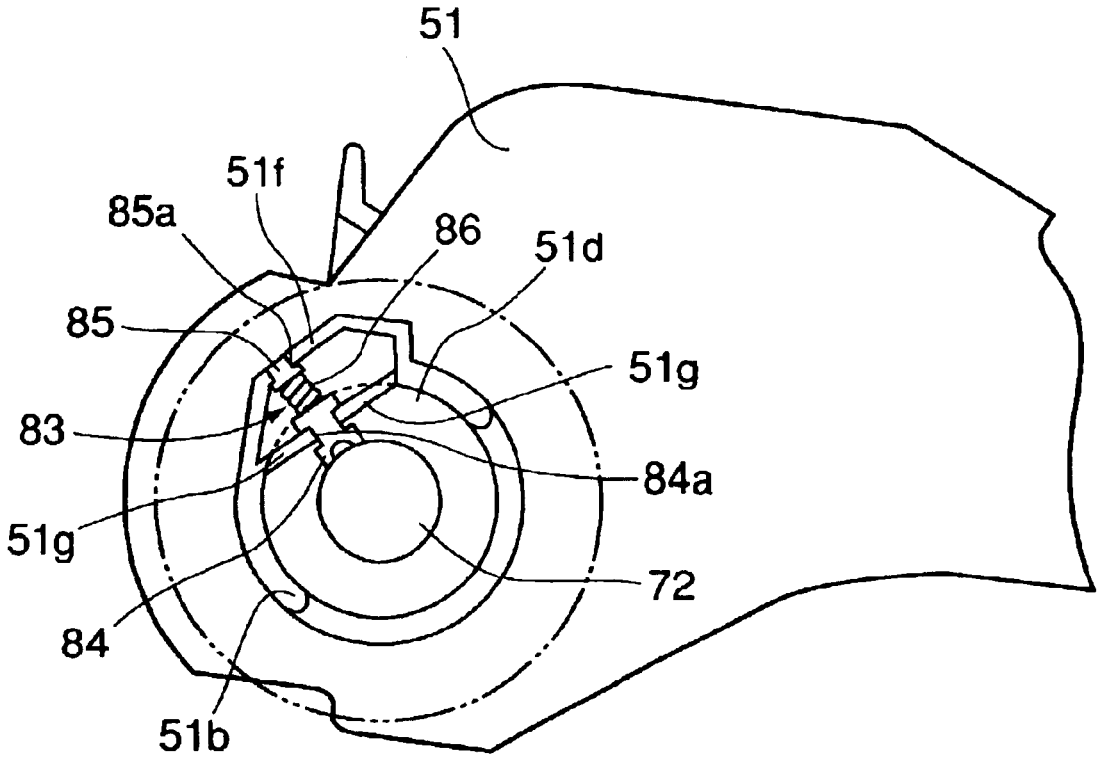
FIG. 8 is a side view of the grounding contact located at one of the lengthwise ends of the photoconductive drum in the process cartridge in the second embodiment of the present invention, for showing the structure of the grounding contact.
Figure 9:
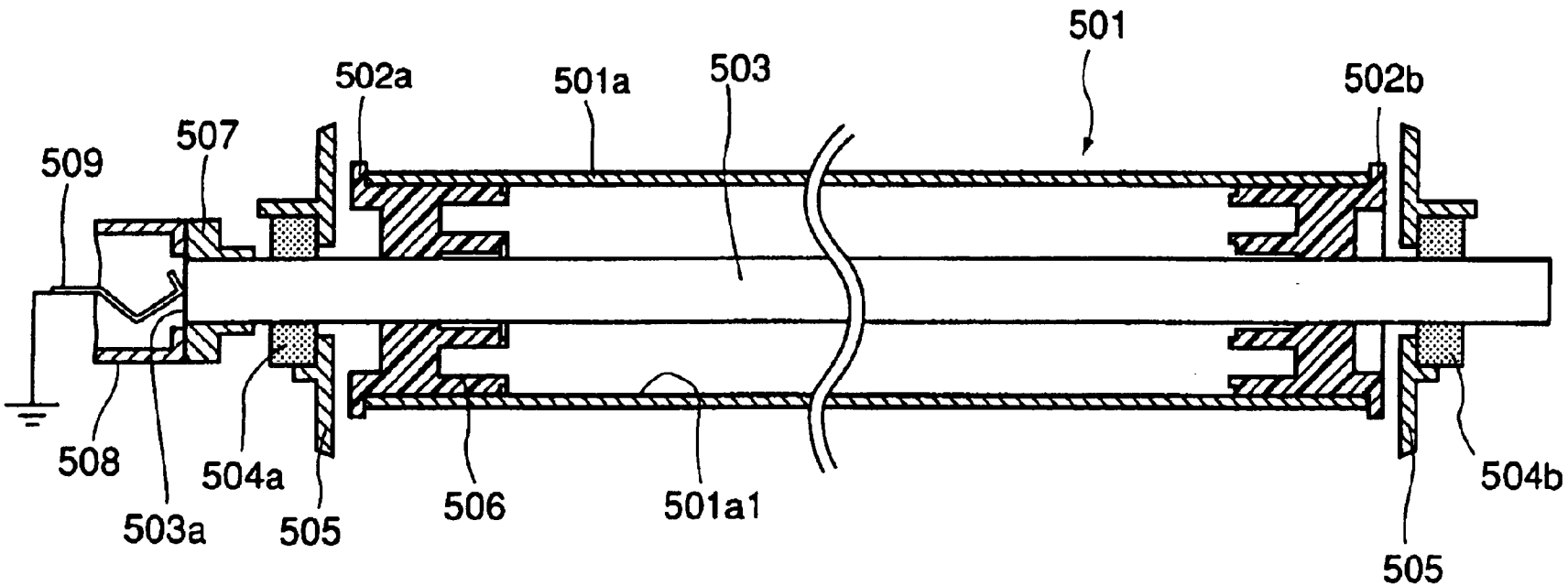
FIG. 9 PRIOR ART
FIG. 9 is a side view of the grounding contact located at one of the lengthwise ends of the photoconductive drum in a typical conventional process cartridge, for showing the structure of the grounding contact.

Next, referring to FIGS. 4 and 8, the second embodiment of the present invention will be described.

Herein, the members, portions, etc., in this embodiment, the descriptions of which are the duplicates of the descriptions of those in the first embodiment, will be given the same referential symbols as those given in the first embodiment, and will not be described.

The structure of the process cartridge 7 is as follows. Referring to FIG. 4, a photoconductive drum 1 comprises an electrically conductive shaft 72, which is put through the through holes 71*b*1 and 71*c*1 of the photoconductive drum 1, extending outward from both lengthwise ends of the photoconductive drum 1 in the axial direction of the photoconductive drum 1. The electrically conductive member 72 is solidly attached to the photoconductive drum 1, and rotates with the photoconductive drum 1. The force for rotationally driving the photoconductive drum 1 is transmitted to the photoconductive drum 1 by an unshown driving force transmitting means, by way of one end of the electrically conductive shaft 72. Referring to FIG. 8, in order to keep the electrically conductive shaft 72 and a helical torsion spring 77 electrically connected, a metallic compression spring unit 83 is employed, which comprises a pair of electrically conductive members constituting the lengthwise ends of the unit 83, one for one.

More specifically, the metallic compression spring unit 83 comprises: a shaft contacting member 84 which constitutes one end of the unit 83, a spring contacting member 85 which constitutes the other end of the unit 83, and an electrically conductive compression spring 86 disposed between the members 84 and 85. The shaft contacting member 84 and spring contacting member 85 are formed of an electrically conductive resin, and are placed in contact with the electrically conductive shaft 72 and helical torsion spring 77, respectively. The cleaner unit frame 51 is provided with a housing portion 51*d* for holding a bearing 73*b*. The housing portion 51*d* is provided with a rib 51*g* which fits in the groove 84*a* of the shaft contacting member 84, and a rib 51*f* which fits in the groove 85*a* of the spring contacting member 85. The metallic compression spring unit 83 is disposed within the housing portion 51*d*, with the ribs 51*g* and 51*f* fitted in the grooves 84*a* and 85*a*, respectively, so that the electrically conductive compression spring 86 remains compressed.

With the provision of the above described structural arrangement, the sliding contact is on the process cartridge side, which is shorter in service life compared to the image forming apparatus main assembly, and the contacts which keep the image forming apparatus main assembly 100 and process cartridge electrically connected are made non-sliding contacts. Therefore, the path through which the photoconductive drum 1 is grounded to the image forming apparatus main assembly 100 is more reliable.

According to the above described embodiments, the contact for keeping the photoconductive drum electrically connected to the main assembly of an image forming apparatus is attached to the portion of the cleaner unit frame, which bears the pressure from the pressure generating member attached to the metallic side plate of the apparatus main assembly to keep the photoconductive drum supporting bearing in contact with the bearing positioning portions of the metallic plate in order to keep the process cartridge accurately positioned relative to the main assembly. With the provision of this structural arrangement, the photoconductive drum can be grounded through the following path: cylindrical member of the photoconductive drum→pressure applying member→side plate; in other words, the photoconductive drum can be grounded without providing the image forming apparatus with electrical contacts dedicated to the grounding of the photoconductive drum.

Further, according to the above described embodiments, the contact for maintaining electrical connection between the photoconductive drum supporting member and the pressure applying member is attached to the cleaner unit frame, provided that the photoconductive drum supporting shaft is electrically conductive, is put through the photoconductive drum, and rotates with the photoconductive drum. With the provision of this structural arrangement, the electrically conductive drum supporting shaft and grounding member are electrically connected with the use of a sliding contact; in other words, the sliding contact is disposed within the process cartridge which is shorter in service life compared to the image forming apparatus main assembly, and the image forming apparatus main assembly and process cartridge are electrically connected with the use of non-sliding contacts. Therefore, the drum grounding path is more reliable.

As described above, according to the present invention, it is assured that a photoconductive drum remains grounded.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

process means actable on said electrophotographic photosensitive drum;

an electroconductive shaft member supporting said photosensitive drum and electrically connected with said photosensitive drum;

a cartridge frame for rotatably supporting said photosensitive drum;

a grounding contact member mounted on said cartridge frame, said grounding contact member including a sliding contact for sliding contact with said electroconductive shaft member and a fixed contact contacted to an urging member provided in the main assembly of the image forming apparatus; and a cartridge positioning member for positioning an axis of said photosensitive drum, wherein said cartridge positioning member is urged to a positioning portion of the main assembly of the image forming apparatus by said fixed contact being urged by said urging member when said process cartridge is mounted to the main assembly of the image forming apparatus, wherein by said fixed contact being contacted and urged by said urging member said photosensitive drum is electrically grounded, and said cartridge positioning member is positioned relative to the positioning portion.

2. A process cartridge according to claim 1, wherein said electroconductive shaft member is rotatably integrated with said photosensitive drum and penetrates said photosensitive drum.

3. A process cartridge according to claim 1 or 2, further comprising a flange member provided at each of opposite ends of said photosensitive drum, said flange member being provided with an engaging hole engaged with said electroconductive shaft member, wherein said grounding contact member is fixed to at least one of said flange members.

4. A process cartridge according to claim 1 or 2, wherein said fixed contact includes an electroconductive resin member fixed on said cartridge frame, and said sliding contact is an electroconductive resin member which is mounted on said cartridge frame and is retractable relative to said electroconductive shaft member, and an electroconductive spring is disposed between said electroconductive resin members.

5. An electrophotographic image forming apparatus for forming an image on a recording material, to which a process cartridge is detachably mountable, comprising:

(i) a positioning portion;

(ii) an urging member;

(iii) a mounting portion for detachably mounting the process cartridge, the process cartridge including:

an electrophotographic photosensitive drum;

process means actable on said electrophotographic photosensitive drum;

an electroconductive shaft member supporting said photosensitive drum and electrically connected with said photosensitive drum;

a cartridge frame for rotatably supporting said photosensitive drum;

a grounding contact member mounted on said cartridge frame, said grounding contact member including a sliding contact for sliding contact with said electroconductive shaft member and a fixed contact contacted to said urging member provided in the main assembly of the image forming apparatus; and a cartridge positioning member for positioning an axis of said photosensitive drum, wherein said cartridge positioning member is urged to said positioning portion by said fixed contact being urged by said urging member when said process cartridge is mounted to the main assembly of the image forming apparatus, wherein by said fixed contact being contacted and urged by said urging member said photosensitive drum is electrically grounded, and said cartridge positioning member is positioned relative to said positioning portion; and (iv) feeding means for feeding the recording material.

6. A process cartridge according to claim 5, wherein said urging member includes a coil spring.

7. A process cartridge detachably mountable to a main assembly of an electrophotographic image forming apparatus, comprising:

an electrophotographic photosensitive drum;

process means actable on said electrophotographic photosensitive drum;

an electroconductive shaft member supporting said photosensitive drum and electrically connected with said photosensitive drum;

a cartridge frame for rotatably supporting said photosensitive drum;

a grounding contact member mounted on said cartridge frame, said grounding contact member including a sliding contact for sliding contact with said electroconductive shaft member and a fixed contact contacted to an urging member provided in the main assembly of the image forming apparatus; and a cartridge positioning member for positioning an axis of said photosensitive drum, wherein said cartridge positioning member is urged to a positioning portion of the main assembly of the image forming apparatus by said fixed contact being urged by said urging member when said process cartridge is mounted to the main assembly of the image forming apparatus, wherein by said fixed contact being contacted and urged by said urging member said photosensitive drum is electrically grounded, and said cartridge positioning member is positioned relative to the positioning portion, wherein said electroconductive shaft member is rotatably integrated with said photosensitive drum and penetrates said photosensitive drum, said process cartridge further comprising a flange member provided at each of opposite ends of said photosensitive drum, said flange member being provided with an engaging hole engaged with said electroconductive shaft member, wherein said grounding contact member is fixed to at least one of said flange members.

8. A process cartridge according to claim 7, wherein said fixed contact includes an electroconductive resin member fixed on said cartridge frame, and said sliding contact is an electroconductive resin member which is mounted on said cartridge frame and is retractable relative to said electroconductive shaft member, and an electroconductive spring is disposed between said electroconductive resin members.

9. An electrophotographic image forming apparatus for forming an image on a recording material, to which a process cartridge is detachably mountable, comprising:

(i) a positioning member;

(ii) an urging member;

(iii) a mounting portion for detachably mounting the process cartridge, the process cartridge including:

an electrophotographic photosensitive drum;

process means actable on said electrophotographic photosensitive drum;

an electroconductive shaft member supporting said photosensitive drum and electrically connected with said photosensitive drum;

a cartridge frame for rotatably supporting said photosensitive drum;

a grounding contact member mounted on said cartridge frame, said grounding contact member including a sliding contact for sliding contact with said electroconductive shaft member and a fixed contact contacted to said urging member provided in the main assembly of the image forming apparatus; and a cartridge positioning member for positioning an axis of said photosensitive drum, wherein said cartridge positioning member is urged to a positioning portion of the main assembly of the image forming apparatus by said fixed contact being urged by said urging member when said process cartridge is mounted to the main assembly of the image forming apparatus, wherein by said fixed contact being contacted and urged by said urging member said photosensitive drum is electrically grounded, and said cartridge positioning member is positioned relative to said positioning portion, wherein said electroconductive shaft member is rotatably integrated with said photosensitive drum and penetrates said photosensitive drum, said process cartridge further comprising a flange member provided at each of opposite ends of said photosensitive drum, said flange member being provided with an engaging hole engaged with said electroconductive shaft member, wherein said grounding contact member is fixed to at least one of said flange members; and (iv) feeding means for feeding the recording material.

10. A process cartridge detachably mountable to a main assembly of an electrophotographic image forming apparatus, comprising:

an electrophotographic photosensitive drum;

process means actable on said electrophotographic photosensitive drum;

an electroconductive shaft member supporting said photosensitive drum and electrically connected with said photosensitive drum;

a grounding contact member mounted on a cartridge frame, said grounding contact member including a sliding contact for sliding contact with said electroconductive shaft member and a fixed contact press-contacted to an urging member provided in the main assembly of the image forming apparatus; and a bearing member for rotatably suporting one end of said electroconductive shaft member, said bearing member being effective to position an axis of said photosensitive drum by being press-contacted to a positioning portion provided in the main assembly of the image forming apparatus by the fixed contact being urged by said urging member;

whereby, by said fixed contact being urged by said urging member, said photosensitive drum is electrically grounded, and the axis of said photosensitive drum is positioned relative to the main assembly of the image forming apparatus.

11. A process cartridge according to claim 10, wherein said fixed contact includes an electroconductive resin member fixed on said cartridge frame, and said sliding contact includes an electroconductive resin member which is mounted on said cartridge frame and which is retractable relative to said electroconductive shaft member, and wherein said grounding contact member further includes an electroconductive spring disposed between said electroconductive resin members.

12. An electrophotographic image forming apparatus for forming an image on a recording material, to which a process cartridge is detachably mountable, said image forming apparatus comprising:

(i) an urging member;

(ii) a positioning portion;

(iii) a mounting portion for detachably mounting the process cartridge, said process cartridge including:

an electrophotographic photosensitive drum;

process means actable on said electrophotographic photosensitive drum;

an electroconductive shaft member supporting said photosensitive drum and electrically connected with said photosensitive drum;

a grounding contact member mounted on a cartridge frame, said grounding contact member including a sliding contact for sliding contact with said electroconductive shaft member and a fixed contact press-contacted to said urging member provided in the main assembly of the image forming apparatus; and a bearing member for rotatably supporting one end of said electroconductive shaft member, said bearing member being effective to position an axis of said photosensitive drum by being press-contacted to said positioning portion provided in the main assembly of the image forming apparatus by the fixed contact being urged by said urging member;

whereby, by said fixed contact being urged by said urging member, said photosensitive drum is electrically grounded, and the axis of said photosensitive drum is positioned relative to the main assembly of the image forming apparatus; and (iv) feeding means for feeding the recording material.

* * * * *

UNITED STATES PATENT AND TRADEMARK OFFICE

CERTIFICATE OF CORRECTION

PATENT NO. : 6,922,536 B2
APPLICATION NO. : 10/329504
DATED : July 26, 2005
INVENTOR(S) : Arimitsu et al.

It is certified that error appears in the above-identified patent and that said Letters Patent is hereby corrected as shown below:

Column 5
Line 1, "6d, and 6d)" should read --6c, and 6d)--.
Line 38, "9d, and 9d)," should read --9c, and 9d),--.

Column 6
Line 5, "remain" should read --remains--.

Column 9
Line 42, "1d" should be deleted.

Column 11
Line 27, "id" should be deleted.

Column 12
Line 9, "id" should be deleted.

Signed and Sealed this

Fifteenth Day of August, 2006

JON W. DUDAS
*Director of the United States Patent and Trademark Office*